United States Patent [19]

Meadows et al.

[11] 3,970,021

[45] July 20, 1976

[54] METHOD OF FABRICATING SHIRT CUFFS

[75] Inventors: James L. Meadows, Honea Path, S.C.; Donald H. Smith, Vidalia, Ga.; Gordon H. Ellington, Vidalia, Ga.; William O. Mitchell, Vidalia, Ga.; W. Wade Frost, Vidalia, Ga.

[73] Assignee: Oxford Industries, Inc., Atlanta, Ga.

[22] Filed: July 3, 1974

[21] Appl. No.: 485,722

Related U.S. Application Data

[60] Continuation-in-part of Ser. No. 391,645, Aug. 27, 1973, which is a division of Ser. No. 243,573, April 13, 1972, Pat. No. 3,780,682, which is a continuation-in-part of Ser. No. 79,031, Oct. 8, 1970, Pat. No. 3,675,604.

[52] U.S. Cl. ..... 112/262; 83/210; 83/236; 83/371; 112/121.29; 112/130

[51] Int. Cl.[2] ..... D05B 19/00

[58] Field of Search ..... 112/2, 121.11, 121.12, 112/121.15, 122, 124, 129, 130, 203, 212, 262; 83/42, 210, 236, 365, 371, 578

[56] References Cited

UNITED STATES PATENTS

| | | | |
|---|---|---|---|
| 2,685,664 | 8/1954 | Visconti | 83/365 |
| 3,203,291 | 8/1965 | Elsas | 83/210 |
| 3,329,113 | 7/1967 | Lewis et al. | 83/365 X |
| 3,401,655 | 9/1968 | Johnson et al. | 112/130 X |
| 3,580,198 | 5/1971 | Teed et al. | 112/203 X |
| 3,605,537 | 9/1971 | Pickler | 83/578 X |
| 3,670,679 | 6/1972 | Campbell | 112/262 |
| 3,760,748 | 9/1973 | Rockerath | 112/130 X |
| 3,772,948 | 11/1973 | Burton | 83/365 X |
| 3,780,682 | 12/1973 | Frost | 112/262 |
| 3,884,166 | 5/1975 | Rinehimer et al. | 112/121.29 |

*Primary Examiner*—Werner H. Schroeder
*Attorney, Agent, or Firm*—Jones, Thomas & Askew

[57] ABSTRACT

A series of shirt cuff pattern parts are placed in overlying relationship on a web of lining material and a conveyor belt engages the upper surfaces of the web of lining material and the pattern parts and holds the layers of material together as they are moved through a sewing machine. The overlying side edge of each of the pattern parts is folded down under an edge of the web of lining material, and the sewing machine sews through the folds. A predetermined range of lengths of the connected together series of partially completed shirt cuffs is continuously accumulated from the sewing machine, and are continually fed from the accumulation to a cutter, and are separated by cutting the web of lining material adjacent the trailing edge of a pattern part so that each partially completed shirt cuff is formed with a short length of the web of lining material protruding from the shirt cuff panel pattern part, and the pattern parts are stacked.

17 Claims, 2 Drawing Figures

METHOD OF FABRICATING SHIRT CUFFS

CROSS REFERENCE TO RELATED APPLICATIONS

This application is a continuation-in-part of application Ser. No. 391,645, filed Aug. 27, 1973, which application is a division of application Ser. No. 243,573 filed Apr. 13, 1972, now U.S. Pat. No. 3,780,682 issued Dec. 25, 1973, which application is a continuation-in-part of application Ser. No. 79,031, filed Oct. 8, 1970, now U.S. Pat. No. 3,675,604 issued July 11, 1972.

BACKGROUND OF THE INVENTION

The process of making shirt sleeve cuffs in the past has required a plurality of difficult alignment and sewing steps and requires skilled machine operators because of the multiple number of plies of outer cuff pattern parts and inner lining pattern parts required to form the cuff, and because the pattern parts are small and are easily misplaced. For example, a typical cuff making process in the past required both the outer cuff panels and inner lining panel to be cut in the cutting room by dye cutting or clicking, and the outer panels and liner panels were tagged in the cutting room and then transferred to the sewing stations in the sewing room. At the first sewing station an operator aligned the inner liner panel with a first cuff panel, folded the overlying edge of the cuff panel over an edge of the liner panel, and sewed through the fold to form a hem or Brighton roll in the cuff panel about the edge of the liner panel. The plurality of partially completed cuffs formed in this manner were connected by a chain stitch and were accumulated at the first sewing station.

After a bunch of partially completed cuffs had been passed through the first sewing station, the bunch was transferred to a second sewing station where the second outer cuff panel was aligned in overlying relationship with the first cuff panel and folded about the hem of the first cuff panel, and the operator then stitched about an end of the fold and around the unstitched edges of the inner liner and cuff panels and over the other end of the fold to complete the cuff. The cuffs were again connected together by chain stitching as they left the sewing station and when the batch of cuffs had been passed through the second sewing station, they were transferred to a processing station where the cuffs were separated, inverted, pressed, and stacked.

The old procedure required not only the cuff panels but the liner to be cut to shape in the cutting room so that a substantial amount of liner material as well as cuff panel material was wasted. Also, the slow processes of aligning the edges of cuff panels and liner panels were required at both the first and second sewing stations, and the sequence of the outer panels had to be maintained at both the first and second sewing stations so that one or both operators would not incorrectly match cuff panels in a cuff structure from different bunches of material or from different layers in a bunch and form cuff structures having mismatched colors.

Several attempts have been made to improve the old piece method of forming shirt cuffs. For example, U.S. Pat. No. 3,670,679 discloses a process where a continuous web of lining material is used in an automated process, where the outer pattern parts of the cuffs are placed on the continuous web of lining material and the pattern parts are sewn to the lining material and the sewn together parts are accumulated in a roll. The lining material is subsequently unrolled and separated between the series of pattern parts. While this system has been somewhat successful in reducing the machine operator time and expense required to manufacture shirt cuffs, the close attention of relatively skilled operators is still required for the step of separating the series of partially completed shirt cuffs, and the process is not a continuous process.

SUMMARY OF THE INVENTION

Briefly described, the present invention comprises a process of forming shirt cuffs or the like wherein a continuous web of cuff lining material noves along a path through a sewing machine, and precut cuff pattern parts are placed in overlying spaced relationship on the lining material. A conveyor belt moves into contact with the lining material and pattern parts and holds them together as they move through the sewing machine. The overlying portion of each pattern part is folded under the web of lining material, and the folded portion of the pattern part and the web of the lining material are sewn together by a sewing machine. As the connected together series of partially formed shirt cuffs leave the sewing machine, they are continuously accumulated in an inverted U-shaped path where the upper portion of the path is movable upwardly or downwardly between predetermined positions to lengthen or shorten the U-shaped path so as to accumulate or feed out the connected series of partially completed shirt cuffs. The connected series is fed from the accumulation through a detector and a cutter to a stacker. The detector determines when the trailing edge of a cuff panel pattern part moves across a predetermined point toward the cutter, and in response to this detection, the movement of the pattern part is interrupted and a disc cutter rolls across the web of lining material adjacent the trailing edge of the pattern part to separate the partially completed shirt cuffs. The partially completed shirt cuffs are moved to a stacker where the individual shirt cuffs are fed to the bottom of a stack and await transfer to a subsequent processing station.

Thus, it is an object of the present invention to provide a continuous process for fabricating partially completed shirt cuffs or the like that requires a relatively unskilled operator and which functions rapidly and accurately to properly form partially completed shirt cuffs.

Other objects, features and advantages of the present invention will become apparent upon reading the following specification, when taken in conjunction with the accompanying drawing.

DETAILED DESCRIPTION

Figure 1:
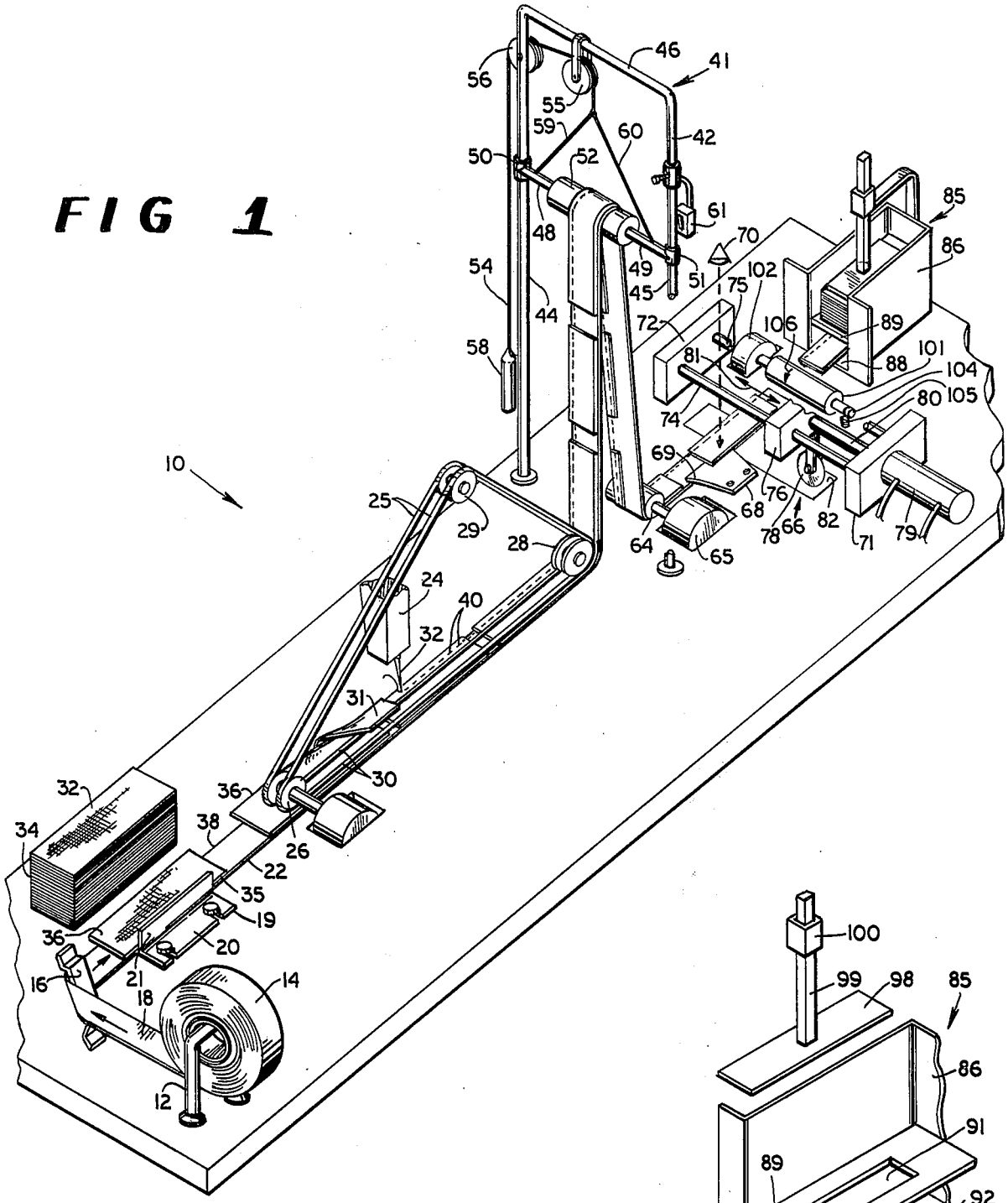
FIG. 1 is a schematic perspective illustration of the apparatus for forming shirt cuffs.

Referring now in more detail to the drawing, in which like numerals indicate like parts throughout both views, FIG. 1 illustrates the apparatus 10 that performs the process of forming the partially completed shirt cuffs, which includes a work table 11 with the various components of the system mounted on the work table. The work table 11 is illustrated as a single work table, but the work table can be formed in separate parts. For example, one work table can support the sewing functions and another work table can support the cutting and stacking functions. A reel support 12 is mounted on work table 11 for the purpose of supporting a supply or reel 14 of web material which ultimately becomes the liner ply of the finished shirt cuff. Web guide 16 is connected to work table 11 and merely functions as a guide to turn the continuous length of web material 18 along the length of work table 11. Second guide or abutment plate 19 is mounted on work table 11 and comprises horizontal plate 20 connected to the work table and upright plate 21 located parallel to the path of one side portion or edge 22 of the web 18. Guides 16 and 19 cause the web 18 to begin its movement along its path across work table 11 and through sewing machine 24.

Conveyor belts 25 move about sewing machine 24, as guided by the pairs of sheaves 26, 28, and 29. The sheaves 26 are located in the path traveled by web 18 so that they move the belt 25 downwardly and then horizontally onto the web 22, so that the lower flight 30 of the conveyor belts 25 moves with the web 18 through the sewing machine. The sheaves 28 take the belts 25 up from the web and pass the belts to the upper sheaves 29, where they pass over the sewing machine back toward the sheaves 26. Sewing machine 24 is a conventional air operated sewing machine, and the sheaves 26 are driven from beneath the work table 11 by a belt drive (not shown) connected to the driving system for the sewing machine. Thus, the lower flight 30 of belts 25 will move in timed relationship with and at the same rate of speed as the feed dogs of the sewing machine to feed the web through the sewing machine. Folder 31 is positioned just ahead of the needle 32 of the sewing machine.

As the sewing machine 24 is operated by the depression of a foot pedal (not shown) by the operator, the web 18 is drawn from reel 14 about guide 16 and 19 through the sewing machine 24. An operator positioned at the edge of the work table 11 repeatedly removes the top ply 32 from a stack or bunch 34 of cuff pattern parts and places the single ply of material on the web with the edge 35 in alignment with the edge 22 of the web. This function is achieved by having the operator place the edge 35 in abutment with the vertical plate 21 of guide 19. The cuff pattern parts in the bunch 34 are wider than the width of web 18, so that the edge or side portion 36 of each pattern part overlies the edge 38 of web 18. Web 18 carries each pattern part with it on its path toward sewing machine 24, and when each pattern part reaches the pair of sheaves 26, the conveyor belts 25 move downwardly onto the top surface of the pattern parts and hold the pattern parts in proper alignment on the web 18 as the pattern parts approach folder 31. Folder 31 is shaped so that it folds the overlying edge portion 36 of each pattern part downwardly and around beneath the edge 38 of web 18. When the pattern parts emerge from folder 31, the fold 37 formed in each pattern part 31 about the edge of the web 18 is sewn by the sewing machine 24 with a continuous stitch 40.

Accumulator or buffer 41 is positioned behind sewing machine 24 in the path traveled by web 18 and includes a support stand 42 mounted on the work table 11, or alternatively mounted from the floor surface (not shown). The stand 42 includes vertical side bars 44 and 45 and horizontal upper bar 46. Support slide 48 is connected to and is movable vertically with respect to the vertical side bars 44 and 45. Support slide 48 includes rod 49 which extends in a horizontal attitude between vertical side bars 44 and 45, sockets 50 and 51 at its ends which surround vertical side bars 44 and 45, and roller 52 intermediate its ends. Support cable 54 is connected to support slide 48 and extends upwardly from the support slide 48 about pulleys 55 and 56, and counterweight 58 is connected to the lower end of support cable 54. The end of support cable 54 connected to support slide 48 is formed in two legs 59 and 60, and the legs of the cable are connected to opposite ends of rod 49 to maintain rod 49 in a horizontal attitude. Upper limit switch 61 is movably mounted on vertical side bar 45 of support stand 42 and a similar limit switch (not shown) is mounted on the same vertical side bar 45 at a lower level and functions as a lower limit switch. The upper and lower limit switches detect the presence of the socket 51 of support slide 48.

Feed roll 64 is mounted on work table 11 and is driven by motor 65. The connected together series of partially completed cuff assemblies is passed from the conveyor belts 25 and the pair of sheaves 28 from the sewing station in an upward direction in an inverted U-shaped path, first in an upward direction, then about roller 52, then in a downward direction to feed roller 64, and then the series is fed by feed roller 64 to cutting mechanism 66.

Cutting mechanism 66 includes a reflective plate 68 attached at one end of its edge portions to work table 11. The free end of the reflective plate 68 extends into the approximate middle portion of the path of web 18. The free edge 69 of the reflective plate 68 which is closest to the on-coming series of cuff assemblies is bent slightly downward toward engagement with web 18 and functions to flip or plow up the leading edge of each pattern part so that while the web 18 travels beneath the reflective plate 18, the pattern part travels over the reflective plate. A photoelectric cell which is schematically illustrated at 70 detects the reflection of light from plate 68, to determine when the trailing end of a pattern part passes over the plate 68. Photoelectric cell 70 functions to actuate the cutter.

Cutting mechanism 66 includes a pair of stationary end supports 71 and 72, a pair of guide rods 74 and 75 connected at their ends to supports 71 and 72, movable cutter support 76, disc cutter 78, and pneumatic ram 79. Pneumatic ram 79 is supported by end support 71 and has its ramrod 80 extending through support 71 and connected at its end to movable support 76. Ram 79 functions to oscillate movable support 76 back and forth along guide rods 74 and 75 as indicated by arrows 81. Disc cutter 78 is mounted on the bottom surface of movable support 76 and engages bearing plate 82. When photoelectric cell 70 detects the trailing end of a pattern part as it moves across reflective plate 68, the control circuitry of the system (not shown) causes feed roller 64 to terminate its feeding motion as the trailing end of the pattern part reaches the path of disc cutter 78, and shifts a solenoid valve to actuate pneumatic ram 79 to move movable support 76 across the path of web 18. The disc cutter 70 walks or rolls on bearing plate 82 and cuts or crushes the material in its path. The disc cutter will cut straight across the web of material at the trailing end of a pattern part. When the disc cutter reaches the opposite side of the path, its movement terminates and the control system reactuates feed roller 64 to feed another pattern part to the path of disc cutter 78. Again, when photoelectric cell 70 detects the trailing end of another pattern part, the movement of the pattern part is interrupted and pneumatic ram 79 is again actuated, but the ram moves movable support 76 and disc cutter 78 in the opposite direction back across the path of web 18, causing the web to again be cut adjacent the trailing end of the pattern part.

Figure 2:
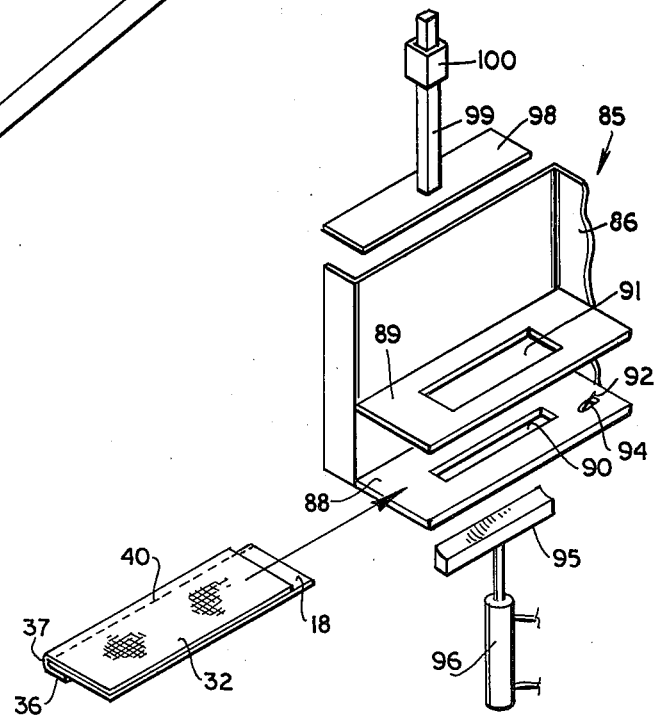
FIG. 2 is a perspective view of the stacker, with parts broken away for clarity.

Stacker 85 is located at the terminal end of the path of the web of lining material and includes an approximately U-shaped housing 86 having an open upper end, and a pair of horizontal partitions 88 and 89 mounted therein. As is illustrated in FIG. 2, each partition 88 and 89 defines an elongated slot 90 and 91, with the slots being in vertical alignment with each other. The wand 92 of a switch protrudes upwardly through an opening 94 in the lower partition 88, and a stuffer block 95 is located below the lower partition 88. Ram 96 is connected to stuffer block 95, and ram 96 functions in response to the depression of switch 92 to move stuffer block 95 upwardly through the aligned slots 90 and 91 of partitions 88 and 89. Holding plate 98 is reciprocatably mounted in housing 86 above upper partition 89. Stem 99 is connected at its lower end to holding plate 98, and bracket 100 surrounds stem 99 and allows the stem to reciprocate in a vertical direction.

A feed roller 101 is positioned between cutting mechanism 66 and stacker 85 so that when the disc cutter separates a partially completed cuff panel from the series of partially completed cuff panels, the separated cuff panel will be moved by the feed roller into the space between the lower and upper partitions 88 and 89 of stacker 85. Feed roller 101 is driven by motor 102, and a solenoid (not shown) mounted beneath the work table is connected to vertically oriented roller support rod 104. Coil compression spring 105 is mounted about support rod 104 and between the work table surface and roller to normally maintain the roller suspended above the work table. When the disc cutter is about to complete its travel across the path of the web material, the motor 102 of the feed roller and the solenoid are actuated for a short duration, whereupon the solenoid pulls the roller down on the partially completed cuff assembly against the bias of spring 105 and motor 102 rotates the roller as indicated by arrow 106. This causes the separated cuff assembly to move into the space between the horizontal plates 88 and 89 of stacker 85. In addition to feed roller 101, air jets (not shown) can be used to impel the cuff assembly toward the stacker.

When a cuff assembly moves into housing 85, it depresses switch feeler 92, which causes ram 96 to distend stuffer block 95 in an upward direction through the aligned slots 90 and 91, thus forcing the material through the upper slot 91. When the material has been moved through the upper slot 91, it resumes its original relatively flat configuration so that it does not tend to move downwardly through the slot 91. The holding plate 98 will move upwardly under the force to stuffer block 95, and when stuffer block 95 returns in a downward direction to its rest position, holding plate 98 will move in a downward direction back in the housing 86 of the stacker. Holding plate 98 functions to prevent the stack formed by stacker 85 from moving too far in an upward direction under the force of stuffer block 95 and therefore moving completely out of housing 86. Also, holding plate 98 exerts a flattening force on the stack in the housing, to compress the stack. When the stack is to be removed from the housing, the operator merely lifts holding plate 98 or its stem 99 in an upward direction and reaches into the housing to grasp the stack and remove the stack from the housing.

The upper limit switch 61 detects the upward movement of bar 49 and the upper end of the inverted U-shaped path traveled by the web 18, and when the upper limit switch 61 is closed, the sewing machine 24 and conveyor belts 25 will be disarmed until cutter 66 functions to deplete the length of web 18 extending through the U-shaped path, thus causing bar 49 to move down the support stand 42 and disengage the upper limit switch. In a similar arrangement, the lower limit switch (not shown) on vertical side bar 45 detects the downward movement of bar 49 and the upper end of the U-shaped path of the web 18 through the accumulator, and when the lower limit switch is closed, cutter 66 will be disarmed until sewing machine 24 and conveyor belt 25 functions to resupply the accumulator 41. The continuous upward force applied by counterweight 58 in accumulator 41 applies tension to the web 18 in the U-shaped path formed by the accumulator 41.

During the operation of the system, the worker can depress the foot pedal to cause sewing machine 24 and conveyor belts 25 to feed the web 18 through the system, and the system can run continuously as long as the worker can continue to place the pre-cut pattern parts from the stack 34 on the web at the guide 19. Should the worker fall behind, the gaps between the pattern parts will become longer, or should the worker function faster than the machine, the length of the gaps between the pattern parts on the web will be very small. Since cutter 66 functions independently of the speed of sewing machine 24 and it is independent of the length of the gaps between the pattern parts, cutter 66 will function properly to cut behind the trailing end of each pattern part, without regard to the length of a gap between the pattern parts. Of course, the worker will be instructed to place the pattern parts closely adjacent one another on the length of web 18 so as to conserve the amount of web required to form a given number of cuff panel assemblies. The worker is also instructed to leave at least a small gap between the pattern parts so the photoelectric cell 70 at the cutter 66 can detect the trailing end of each pattern part as it approaches the path of the disc cutter 78. Thus, each partially completed cuff assembly that moves into stacker 85 will have one edge of the web of lining material cut evenly with one edge of a pattern part and the other edge of the web lining material will protrude beyond the opposite edge of the cuff pattern part.

While this invention has been described in detail with particular reference to preferred embodiments thereof, it will be understood that variations and modifications can be effected within the spirit and scope of the invention as described hereinbefore and as defined in the appended claims.

We claim:

1. A continuous process of forming shirt cuffs or the like comprising moving the free end of a continuous web of lining material or the like from a supply along a path through a sewing machine, placing a series of panels of cuff material or the like in spaced relationship with respect to one another on the web of lining material along the length of the web of lining material before the web of lining material is moved through the sewing machine, folding an edge portion of the series of panels of cuff material about an edge of the continuous web of lining material, sewing through the folds of the series of panels of cuff material and the continuous web of lining material to form a connected series of partially completed cuff assemblies, accumulating a predetermined length of the connected series of partially completed cuff assemblies which extend from the sewing machine, continually cutting the free end of the web between the panels to separate the partially completed cuff assemblies from the connected series of partially completed cuff assemblies in response to the accumulation of at least a first predetermined length of the connected series of partially completed cuff assemblies and terminating the separating of the series of partially completed cuff assemblies in response to the accumulation of less than the first predetermined length of the connected series of partially completed cuff assemblies and terminating the moving of the web of lining material and the series of panels of cuff material through the sewing machine in response to the accumulation of more than a second predetermined length of the connected series of partially completed cuff assemblies.

2. The process of claim 1 and wherein the step of continually cutting the partially completed cuff assemblies from the series of partially completed cuff assemblies comprises the steps of simultaneously moving the web of lining material beneath a reflective plate while moving the panels of cuff material over the reflective plate, detecting the movement of an edge portion of each panel of cuff material as it moves over the reflective plate, terminating the movement of the series of partially completed cuff assemblies after the detected edge portion of a panel has moved to a predetermined position, and cutting the series of partially completed cuff assemblies at the detected edge portion.

3. The process of claim 1 and wherein the step of continually cutting the partially completed cuff assemblies from the series of partially completed cuff assemblies comprises the cycle of rolling a disc cutter against a bearing plate from one side of the path of the series of partially completed cuff assemblies in a first direction across the path to the other side of the path, indexing the next adjacent partially competed cuff assembly along the path, rolling the disc cutter against the bearing plate in the direction opposite to the first direction from the other side of the path back across the path to the one side of the path, and indexing the now next adjacent partially completed cuff assembly along the path.

4. The process of claim 1 and further including the step of forming a vertical stack of cuff assemblies with the last stacked cuff assembly being placed on the bottom of the stack.

5. The process of claim 1 and further including the step of sequentially moving the separated partially completed cuff assemblies to a stacking position and urging each partially completed cuff assembly in an upward direction to the bottom of a stack of partially completed cuff assemblies.

6. A continuous process of forming shirt cuffs or the like comprising the steps of moving a web of cuff lining material or the like extending from a supply in a first direction along its length toward a sewing machine, placing cuff panel pattern parts or the like on the web of lining material as the web of lining material moves toward the sewing machine with one edge portion of each of the cuff panel pattern parts overlying an edge of the web of lining material and with the cuff panel pattern parts being spaced from one another along the length of the web of lining material, folding the overlying edge portion of each of the cuff panel pattern parts about an edge of the web of the lining material as the web of lining material moves toward the sewing machine, sewing through the web of lining material and the folded portion of the cuff panel pattern parts to form a connected series of partially completed shirt cuffs, accumulating a predetermined range of lengths of the connected series of partially completed shirt cuffs which has moved through and which extends from the sewing machine, moving the connected series of partially completed shirt cuffs from its accumulation and severing the web of lining material adjacent one edge of each cuff panel pattern part to separate the partially completed shirt cuffs from the connected series of partially completed shirt cuffs and leave a short length of cuff lining material extending from one edge of at least some of the partially completed shirt cuffs.

7. The process of claim 6 and wherein the step of severing the web of lining material between the precut pattern parts of cuff panel material comprises moving the web of cuff lining material on one side of a reflective surface and moving the cuff panel pattern parts on the opposite side of the reflective surface as the partially completed shirt cuffs move toward a cutting station, detecting the movement of a cuff panel pattern part across the reflective surface, and cutting the web of lining material in response to the detection.

8. The process of claim 6 and further including the step of moving the partially completed shirt cuffs in an upward direction to form a stack with the partially completed shirt cuffs being added to the bottom of the stack.

9. The process of claim 6 and further including the step of urging the partially completed shirt cuffs as they are cut toward a stacking station.

10. The process of claim 6 and wherein the step of accumulating a predetermined range of lengths of the connected series of partially completed shirt cuffs comprises moving the connected series of partially completed shirt cuffs through an inverted U-shaped path and moving the upper portion of the path upwardly and downwardly to lengthen and shorten the path.

11. The process of claim 6 and wherein the step of accumulating a predetermined range of lengths of the connected series of partially completed shirt cuffs comprises moving the connected series of partially completed shirt cuffs through an inverted U-shaped path and moving the upper portion of the path upwardly or downwardly to lengthen or shorten the path, and further including the step of terminating the step of severing the web of cuff lining material in response to the movement of the upper portion of the inverted U-shaped path below a predetermined position.

12. The process of claim 6 and wherein the step of accumulating a predetermined range of lengths of the connected series of partially completed shirt cuffs comprises moving the connected series of partially completed shirt cuffs through a U-shaped path and varying the length of the U-shaped path.

13. A process of forming shirt cuffs or the like comprising moving a continuous web of lining material or the like along a path through a sewing machine, placing a series of shirt cuff pattern parts or the like on the web of lining material at spaced intervals along the web of lining material so that the web of lining material carries the series of shirt cuff pattern parts along the path, connecting a side portion of the shirt cuff pattern parts to the lining material along one side of the lining material to form a connected series of shirt cuff assemblies, moving the portion of the web of lining material away from its connected side portion beneath a reflective surface as the connected series of shirt cuff assemblies continues to move along the path and moving the portions of the shirt cuff pattern parts away from their connected side portions over the reflective surface, detecting the movement of each of the pattern parts over the reflective surface, and actuating a subsequent garment making step in response to the detection of the movement of each of the pattern parts over the reflective surface.

14. The process of claim 13 and further including the step of separating the connected series of shirt cuff assemblies at one edge of each shirt cuff pattern part.

15. A continuous process of forming shirt cuffs or the like comprising moving a continuous web of lining material or the like along its length along a path toward a cutting mechanism, placing shirt cuff pattern parts or the like on the web of lining material in spaced relationship with respect to one another, attaching the shirt cuff pattern parts to the web of lining material along one edge of the web of lining material to form a connected series of partially completed shirt cuffs, moving the web of lining material on one side of a reflective plate while moving the shirt cuff pattern parts on the other side of the reflective plate as the continuous web of lining material moves along its length toward the cutting mechanism, detecting the presence and absence of the shirt cuff pattern parts as they move across the reflective plate, and cutting the continuous web of lining material between adjacent ones of the shirt cuff pattern parts in response to the detection of the presence and absence of the shirt cuff pattern parts as they move across the reflective plate.

16. The process of claim 15 and wherein the step of cutting the web of lining material comprises stopping the movement of the lining material.

17. The process of claim 15 and wherein the step of cutting the web of lining material comprises rolling a disc cutter against a bearing plate from one side of the path of the web of lining material to the other side of the path.

* * * * *

UNITED STATES PATENT OFFICE

CERTIFICATE OF CORRECTION

Patent No. 3,970,021 Dated July 20, 1976

Inventor(s) James L. Meadows et al.

It is certified that error appears in the above-identified patent and that said Letters Patent are hereby corrected as shown below:

The heading "Related U.S. Application Data" and the data following this heading, all of which appears in the first column of the cover page of the patent, should be deleted.

In Column 1, the heading "Cross Reference to Related Applications", and the data following this heading should be deleted.

Signed and Sealed this

Twenty-eighth Day of September 1976

[SEAL]

*Attest:*

RUTH C. MASON
*Attesting Officer*

C. MARSHALL DANN
*Commissioner of Patents and Trademarks*